US006866501B2

(12) United States Patent
Wang et al.

(10) Patent No.: US 6,866,501 B2
(45) Date of Patent: Mar. 15, 2005

(54) BURNER ASSEMBLY FOR DELIVERY OF SPECIFIED HEAT FLUX PROFILES IN TWO DIMENSIONS

(75) Inventors: Shoou-I Wang, Allentown, PA (US); Xianming Jimmy Li, Orefield, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/842,083

(22) Filed: May 10, 2004

(65) Prior Publication Data

US 2004/0209208 A1 Oct. 21, 2004

Related U.S. Application Data

(63) Continuation of application No. 10/093,566, filed on Mar. 7, 2002, now abandoned.

(51) Int. Cl.[7] ..... F23C 5/00
(52) U.S. Cl. ..... 431/8; 431/9; 431/174
(58) Field of Search ..... 431/8, 9, 174, 431/175, 176, 146, 147

(56) References Cited

U.S. PATENT DOCUMENTS

| | | | | |
|---|---|---|---|---|
| 2,654,657 A | | 10/1953 | Reed | |
| 2,751,893 A | | 6/1956 | Permann | |
| 3,139,138 A | | 6/1964 | Bloom | |
| 4,342,642 A | | 8/1982 | Bauer et al. | |
| 4,505,666 A | | 3/1985 | Martin et al. | |
| 5,295,820 A | | 3/1994 | Bilcik et al. | |
| 5,542,839 A | * | 8/1996 | Kelly | 431/10 |
| 5,906,485 A | | 5/1999 | Groff et al. | |
| 5,934,898 A | * | 8/1999 | Fayerman | 431/353 |
| 5,993,193 A | | 11/1999 | Loftus et al. | |
| 6,007,328 A | | 12/1999 | Seyed Yagoobi et al. | |
| 6,050,809 A | * | 4/2000 | Fayerman | 431/114 |
| 6,126,438 A | * | 10/2000 | Joshi et al. | 431/161 |
| 6,334,770 B1 | | 1/2002 | Giraud et al. | |

FOREIGN PATENT DOCUMENTS

| | | |
|---|---|---|
| GB | 274475 | 11/1927 |
| JP | 59010341 | 1/1984 |
| WO | 8502248 | 5/1985 |
| WO | 9852868 | 11/1998 |

* cited by examiner

*Primary Examiner*—Alfred Basichas
(74) *Attorney, Agent, or Firm*—Keith D. Gourley

(57) ABSTRACT

A burner is provided which includes a plurality of burner subunits that each share a single air supply, a single fuel supply and a single control system. Each burner subunit has a plurality of air orifices and a plurality of fuel orifices of sufficient quantity and of a cross-sectional area to control a transverse heat flux profile of the burner. The burner subunits are spaced with respect to one another to control a longitudinal heat flux profile of the burner. The single air supply and said single fuel are adapted to provide an air-fuel mix that ensures the transverse and the longitudinal heat flux profiles are maintained at different fuel and air input rates. A burner of similar design using premixed air and fuel is also disclosed.

23 Claims, 3 Drawing Sheets

BURNER ASSEMBLY FOR DELIVERY OF SPECIFIED HEAT FLUX PROFILES IN TWO DIMENSIONS

This application is a contribution of Ser. No. 10/093,566 filed Mar. 7, 2002 now abn.

BACKGROUND OF THE INVENTION

The present invention is directed to gas fired burners. In particular, the present invention is directed to gas fired burners of the type which may be used in industrial furnaces and the like.

U.S. Pat. No. 5,993,193 (Loftus et al.) discloses a gas fired burner for use in applications such as chemical process furnaces for process heaters in refineries and chemical plants. The burner is provided with a plurality of fuel gas inlets for enabling manipulation of the flame shape and combustion characteristics of the burner based upon variation in the distribution of fuel gas between the various fuel gas inlets. This invention is directed to varying the pattern of heat flux being produced when the burner apparatus is in operation. However, the invention here is directed to a circular burner with intricate design aimed at achieving a great degree of premixing and reduced NOx emissions. More importantly, the heat flux pattern here is the longitudinal heat flux distribution along the flame. This disclosure does not teach heat flux distribution across the burner opening, perpendicular to the flow of flue gas immediately outside the burner opening.

U.S. Pat. No. 5,295,820 (Bicik et al.) teaches a linear burner with jets extending through an opening made in a wall of a body of the burner defining an air-distribution chamber. The jets are connected to a series of tubes for supplying fuel gas or a gas/air mixture with the tubes passing through the body of the burner in order to be connected on the outside to a distribution housing provided with gas or with a gas/air mixture. The housing has a means to selectively supply the tubes joined to the jets. The intent here is to have a burner with a wide range of heating power, or turndown ratio. However, this invention does not teach a single air supply, single fuel supply, and single burner control system so as to simplify the design and reduce costs while achieving an object of a desired heat release profile dictated by process requirements.

Additionally, there are arrangements of a multitude of burners in furnaces that achieve a uniform heat flux at a given elevation and a given heat flux profile along the elevation, such as in a side-fired reformer or a terraced-wall reformer, generally known in the art. However, these burners are individually controlled. They do not share a common fuel supply manifold or a common air supply manifold. As burners, they are not able to deliver specified heat flux profiles in two dimensions simultaneously. In addition, their cost is usually very high because of the need for individual controls.

It would be desirable to have a burner design that would meet specified heat flux profiles in two dimensions (e.g., longitudinal and transverse dimensions) simultaneously. It would also be desirable for the above to be achieved while meeting safety, flame stability, and low-cost requirements.

BRIEF SUMMARY OF THE INVENTION

In a first preferred embodiment, a burner is provided which includes a plurality of burner subunits. The burner subunits share a single air supply, a single fuel supply and a single control system. Each burner subunit has a plurality of air orifices and a plurality of fuel orifices. The plurality of air orifices and the plurality of fuel orifices are of sufficient quantity and each air orifice and each fuel orifice is of a cross-sectional area to control a transverse heat flux profile of the burner. The burner subunits are spaced with respect to one another to control a longitudinal heat flux profile of the burner. The single air supply and the single fuel supply provide an air-fuel mix that ensures that the transverse heat flux profile and the longitudinal heat flux profile are maintained at different fuel and air input rates.

Each of the plurality of burner subunits may be spaced at variable spacing with respect to one another to control the longitudinal heat flux profile. Alternatively, each of the plurality of burner subunits may be spaced at a constant distance with respect to one another, where each of the subunits have different heat release rates, to control the longitudinal heat flux profile. Alternatively still, each of the plurality of burner subunits may be spaced at either variable spacing or constant spacing with respect to one another to control the longitudinal heat flux profile.

Each of the plurality of burner subunits may have a plurality of air orifices of a desired cross-sectional area where each air orifice is adapted to create a flamelet to control the transverse heat flux profile of the burner.

In another preferred embodiment of the present invention, a burner is provided which also includes a plurality of burner subunits. The burner subunits share a single air/fuel supply and a single control system. Each burner subunit has a plurality of air/fuel orifices where the plurality of air/fuel orifices are of sufficient quantity and each air/fuel orifice is of a cross-sectional area to control a transverse heat flux profile of the burner. The burner units are spaced with respect to one another to control a longitudinal heat flux profile of the burner. The air/fuel supply provides an air-fuel mix that ensures that the transverse heat flux profile and the longitudinal heat flux profile are maintained at different fuel and air input rates.

Each of the plurality of burner subunits may be spaced at variable spacing with respect to one another to control the longitudinal heat flux profile. Alternatively, each of the plurality of burner subunits may be spaced at a constant distance with respect to one another, where each of the subunits have different heat release rates, to control the longitudinal heat flux profile. Alternatively still, each of the plurality of burner subunits may be spaced at either at variable spacing or constant spacing with respect to one another to control the longitudinal heat flux profile. Each of the plurality of burner subunits may have a plurality of air/fuel orifices of a desired cross-sectional area where each air/fuel orifice creates a flamelet to control the transverse heat flux profile of the burner.

DETAILED DESCRIPTION OF THE INVENTION

Figure 1:
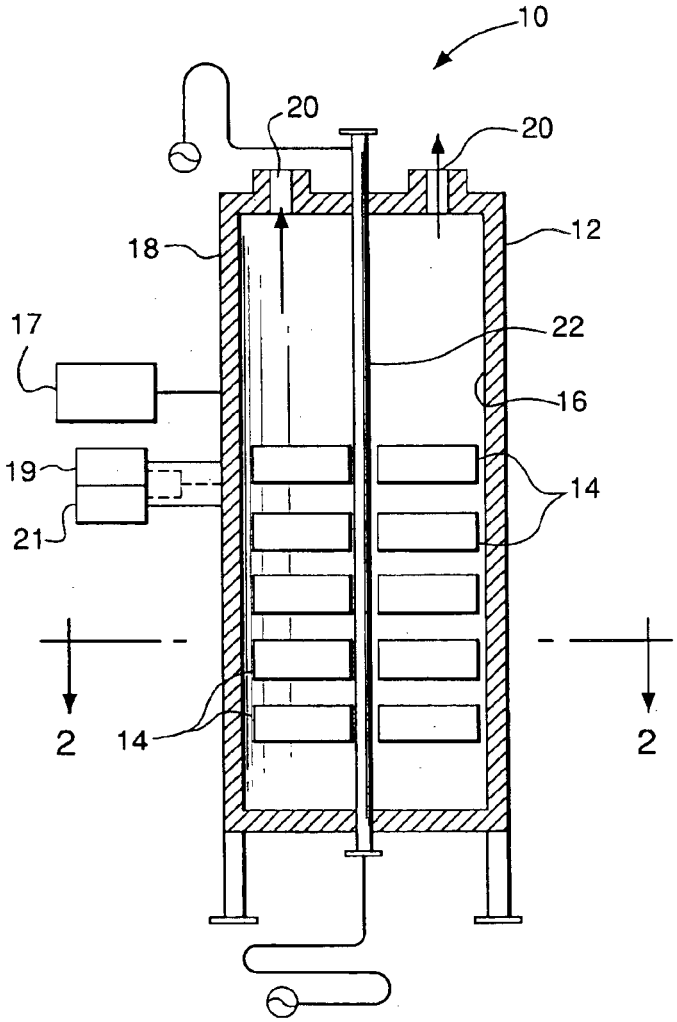
FIG. 1 is a simplified cross-sectional side view of a cylindrical steam reformer in accordance with the present invention.

The present invention is directed to a novel burner design for a furnace whereby specified heat flux profiles in two dimensions (e.g., along a burner longitudinal axis and along a burner transverse axis) are achieved simultaneously. A furnace to which the present invention is applied has one or more burner assemblies. Each burner assembly consists of a number of burner subunits that share the same air supply, fuel supply and control system. The number and size of air and fuel orifices in each burner subunit control the transverse profile of the flame within the burner, the spacing among the burner units controls the longitudinal profile of the flame within the burner, and a special air-fuel mixing approach ensures that the heat flux profiles maintain the same shape at different fuel and air input rates.

For purposes of the present invention, the term "longitudinal" refers to the longitudinal axis of the burner and the term "transverse" refers to axes perpendicular to the longitudinal axis of the burner.

To achieve the objectives of this invention, three principles are used together to create a novel design apparatus.

First, the heat flux profile requirement for the particular furnace is reduced into solvable sub-problems by physical subdivision. The required heat release is provided in the form of fuel to meet the targeted heat transfer requirement in each subdivision. This principle is applied to the longitudinal heat flux profile (i.e., a heat flux profile with respect to the longitudinal axis of the burner), which is achieved through the use of a plurality of subunits within the burner assembly. These subunits may be: (1) subunits having the same heat release rate and placed at a variable spacing, (2) subunits having different heat release rates and placed at a fixed spacing, or (3) a combination of (1) and (2) above. This principle can also be applied at the level of each subunit so that a plurality of flamelets, each responsible for a prescribed target area of heat transfer, collectively achieves a desired transverse heat flux profile at each elevation.

Second, it is known that the length of a turbulent flame is directly proportional to its nozzle (orifice) diameter. See, for example, J. M. Beer and N. A. Chigier, *Combustion Aerodynamics*, John Wiley and Sons, New York, 1972 at page 40. See also H. Tennekes and J. L. Lumley, *A First Course in Turbulence*, The MIT Press, 1990 at page 22. This principle is used to control the length of the flamelets within each subunit of the burner assembly so that the desired amount of energy is delivered to the target location at a given distance away from the subunit. Accordingly, more orifices of smaller diameters will produce a shorter flamelet. Conversely, fewer orifices of larger diameters will produce a longer flamelet. This principle is directed to the transverse heat flux profile of the furnace (i.e., the heat flux profile of the furnace of a plane that is perpendicular to the longitudinal heat flux profile of the furnace).

Third, proper air-fuel ratios are maintained and air staging is used to control flame temperature. Although a premixed design may offer certain performance benefits, safety requirements may favor a non-premixed approach. Whether premixed or non-premixed, proper air-fuel mixing is critical to achieving flame shape and heat flux profiles. Furthermore, in a non-premixed design, not only must the overall fuel-ratio be correct, ratios within each subdivision must also be carefully controlled so that the primary stage, secondary stage, etc., all have proper stoichiometries. In addition, the intersection points of fuel and air jets must be properly controlled.

The objective of low capital cost is achieved by consolidating the flow manifolds and burner controls. Regardless of the number of subunits in the assembly of the present invention, there is only one air control valve and one fuel control valve. The proper distribution of air and fuel is achieved by appropriately sizing air ducts and fuel pipes.

Cylindrical Steam Hydrocarbon Reformer

Referring now to the drawings, wherein like part numbers refer to like elements throughout the several views, there is shown in FIG. 1 a cylindrical steam reformer 10 designed in accordance with the present invention. This reformer 10 may be, for example, a reformer as described in a U.S. application Ser. No. 09/741,284, filed Dec. 20, 2000, and entitled Reformer Process with Variable Heat Flux Side-Fired Burner System, the complete specification of which is hereby fully incorporated by reference.

The steam reforming process is a well known chemical process for hydrocarbon reforming. Typically, a hydrocarbon and steam mixture (a mixed feed) reacts in the presence of a catalyst to form hydrogen, carbon monoxide, and carbon dioxide. Since the reforming reaction is strongly endothermic, heat must be supplied to the reactant mixture, such as by heating the tubes in a furnace or reformer. The amount of reforming achieved depends on the temperature of the gas leaving the catalyst. Exit temperatures of 700 to 900 degrees Celsius are typical for hydrocarbon reforming.

Figure 2:
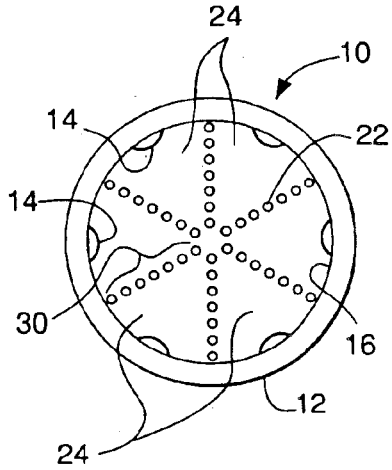
FIG. 2 is a simplified cross-sectional view of the steam reformer of FIG. 1 taken substantially along lines 2—2 of FIG. 1.

As can be seen in FIGS. 1 and 2, the reformer 10 of this example of the present invention includes a cylindrically shaped, refractory lined shell 12. Multiple burner subunits 14 are located along the inner wall 16 of the shell 12. At the upper end 18 of the shell 12, there are one or more openings 20 that allow the flue gas (containing combustion products) to flow from the shell 12. Conventional reformer tubes 22 containing catalyst are positioned within the interior of the shell 12 to utilize high intensive radiant heat directly from the flames of the burner subunits 14. Fuel supply 17, air supply 19, and control system 21 are also shown in schematic form.

The cylindrical reformer 10 requires burner subunits 14 that produce a specified heat flux along each reformer tube 22 (i.e., a longitudinal heat flux profile), and, at any given elevation of the reformer tube 22, the heat flux profile must be uniform among a number of tubes 22 (i.e., the transverse profile).

As can be seen in FIG. 2, The cylindrical reformer 10 of this example is divided into a plurality of pie-shaped sectors 24, here, six sectors. Each sector 24 requires a burner assembly (that includes burner subunits 14) that is mounted on the inner wall 16 of the shell 12 along the length of shell 12. The burner subunits 14 are fired horizontally and radially in an inward direction. This arrangement requires the burner subunits 14 to produce a uniform heat flux at a given elevation on the sides of the sector where reformer tubes 22 are installed in radial rows 30. The flame must be compact to avoid local hot spots. Furthermore, the process requires an optimum heat flux profile along each reformer tube 22, generally known in the catalytic steam methane reforming art.

Figure 3:
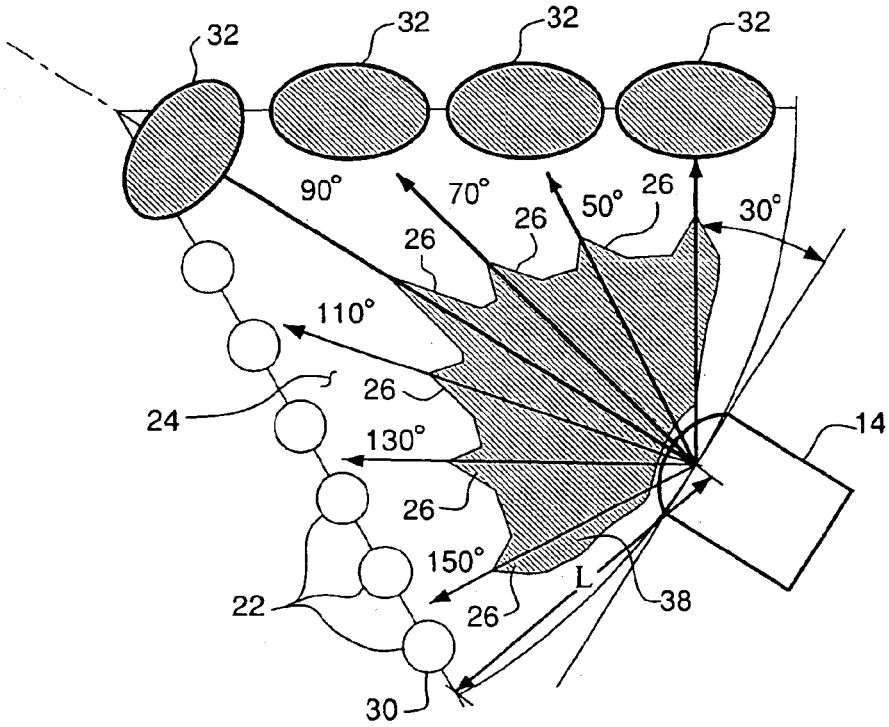
FIG. 3 is a schematic diagram of a burner subunit for use in the reformer of FIG. 1 with variable lengths of flamelets and heat transfer targets.

These two heat flux profile requirements limit the flame of each subunit 14 to a fan shape 38 (see FIG. 3). The burner subunits 14 must operate for a range of fuels and air preheat temperatures.

As seen in FIG. 3, to achieve a uniform heat flux radially at a given elevation, the total heat release from a burner subunit 14 can be divided into arrays of flamelets 26 that create the fan shape 38, each of which aims at a given cluster of reformer tubes 22, which are the targets of heat transfer 32. If, for example, each flamelet 26 is to cover the same heat transfer surface area, the heat release for each array must be uniform. That is, the fuel supply used to create the fan shape is identical. In addition, the distance from the burner subunit 14 (which, in this example, is mounted at the center of the sector on the sidewall) to each of the cluster of reformer tubes 22 (i.e., the target of heat transfer 32) is not uniform because of the pie-shaped geometry. For the heat transfer to each cluster of tubes to be uniform, the subunit 14 must produce different flame lengths for different flamelets 26. This requirement is achieved through the use of variable orifice sizes.

In this example reformer 10, there are six pie-shaped sectors 24 and seven reformer tubes 22 along each radial row 30 of reformer tubes 22 that divide the sectors 24. FIG. 3 depicts one of the six pie-shaped sectors 24. As indicated above, the reformer tubes 22 are preferably arranged uniformly along the radial rows 30. Here, it is desired that the burner subunit 14 be constructed to provide seven flamelets 26, so that each flamelet 26 covers a pair of reformer tubes 22. As shown in FIG. 3, the flamelet angles are approximately 30, 50, 70, 90, 110, 130, and 150 degrees, and the heat release is preferably approximately equal for each of the seven flamelets 26. Due to symmetry, flamelets 26 at each of 30 & 150 degrees, 50 & 130 degrees, and 70 & 110 degrees must have substantially the same profile. Also as shown, the distance to each of the desired heat transfer target 32 varies due to the cylindrical geometry. If it is assumed that the distance for the 30-degree flamelet is 1 unit based on this geometry, the distance for the 50 degree flamelet is 1.08 units, the distance for the 70 degree flamelet is 1.32 units, and the distance for the 90 degree flamelet is 1.89. This arrangement is shown in FIG. 3.

Figure 4:
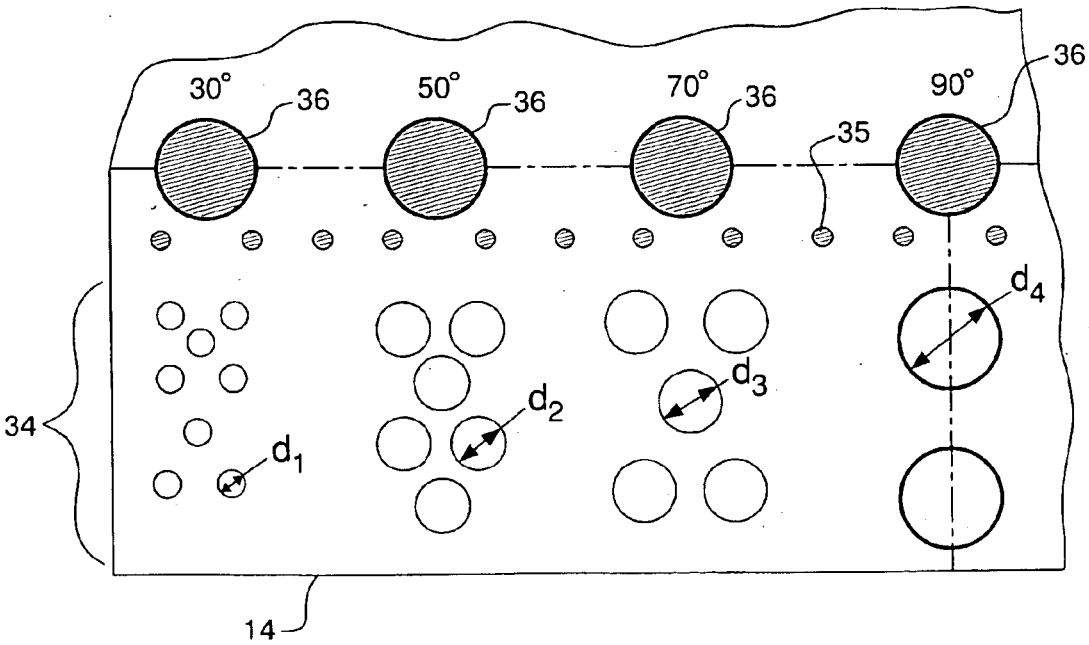
FIG. 4 is a simplified view of one quarter of a fuel orifice arrangement and air orifice arrangement used in the burner subunit of FIG. 3.

Based on the geometry indicated in the preceding paragraph, and the fact that flow rate is proportional to orifice cross-sectional area, the following relationships are derived from the design principles disclosed here:

$$\frac{L_1}{d_1} = \frac{L_2}{d_2} = \frac{L_3}{d_3} = \frac{L_4}{d_4} = \ldots = \frac{L_i}{d_i}$$

where n is number of orifices in each angle (e.g., the 30 degree angle, the 50 degree angle, the 70 degree angle, etc.), d is orifice diameter (see FIG. 4), and L is length from the burner subunit to the tube row 30 in each angle (See FIG. 3). In this example, the first angle is at 30 degrees (subscript 1), the second angle is at 50 degrees (subscript 2), and so forth. Description of only four angles is needed for a complete description of the system because of symmetry. To control the lengths of the flamelets 26 for associated heat transfer target areas 32, the air orifice arrangement 34 (see FIG. 4) can be calculated using these formulas. FIG. 4 depicts a quarter of the burner subunit 14 face and shows the air orifice arrangement 34 and the fuel tip arrangement 36. Ignition air orifices 35 are also shown. The remaining three quarters have the same configuration due to symmetry. Here, it is recognized that the air jet momentum overwhelms fuel jet momentum in air-fuel combustion, therefore variable orifice sizes for fuel are generally unnecessary. It is also clear to those skilled in the art that these orifices can be for a premixed oxidant-fuel mixture rather than oxidant alone. Furthermore, if the fuel momentum is significant, such as in cases of low-heating-value fuels, a similar arrangement can be devised for the fuel orifices as well. It is noted that, to this point, the first and second principles, as described above, have been applied.

To ensure flame stability and to achieve a desired flame shape, the third principle above, i.e., proper air-fuel ratios, must be applied in arranging the air orifices. Industry guidelines on the ratio of primary air to total air is usually between 40 to 60%, but the ratio could be as low as about 25%, or as high as about 75%. As FIG. 4 suggests, which depicts the air orifice arrangement 34 and fuel orifice arrangement 36 of one quarter of a burner subunit 14, the amount of primary air stays within that guideline. Note that the burner subunit 14 is symmetric about both the X and Y axes shown. The orifice arrangement here achieves variable lengths of flamelets 26. FIG. 4 also shows orifices for ignition air flow 35 as a further measure to ensure flame stability.

Figure 5:
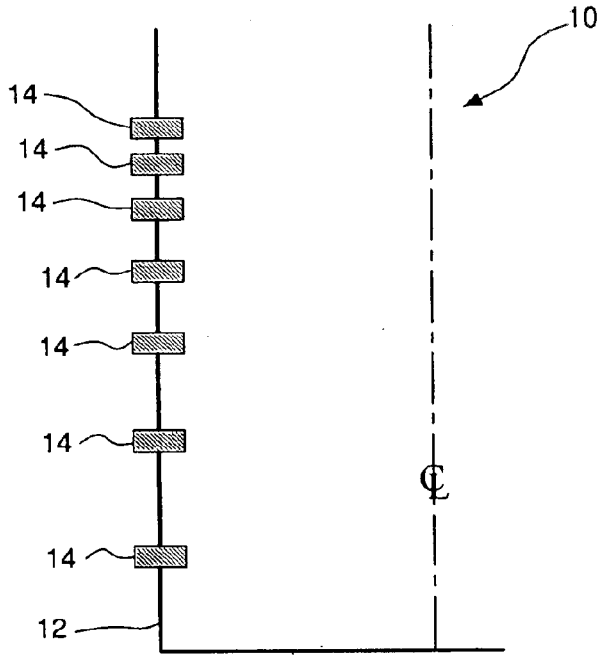
FIG. 5 is a simplified side elevation view of the reformer of one half of the reformer of FIG. 1, depicting an example of variable spacing of identical subunits. Piping and control are not shown.

The desired longitudinal heat flux profile can be achieved by arranging the burner subunits 14 in a manner similar to that of FIG. 5, which illustrates variable spacing with identical subunits. It is recognized that it is possible to use variable spacing or variable heat release capacity, or a combination thereof, to achieve the same result.

Prototype Test Data

Figure 6:
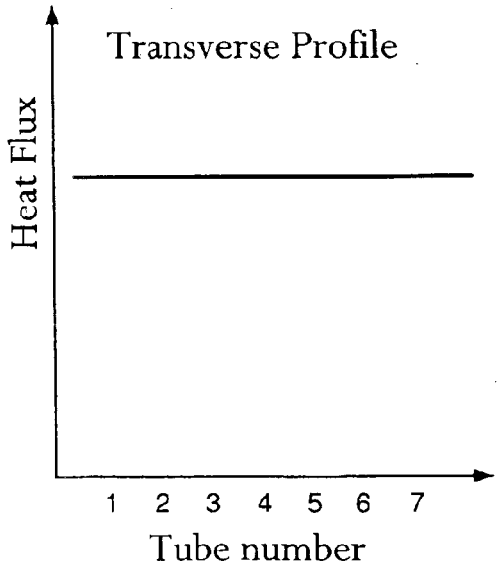
FIG. 6 is a graphical depiction of an ideal transverse profile of heat flux of the reformer of FIG. 1.
Figure 7:
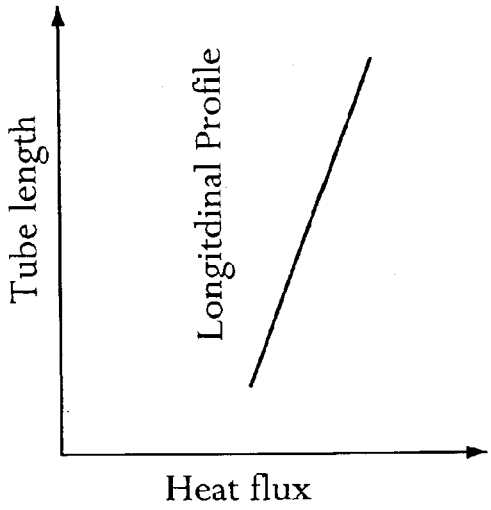
FIG. 7 is a graphical depiction of an ideal longitudinal profile of heat flux in the reformer of FIG. 1.

One burner assembly consisting of six subunits was constructed and tested in a vertical cylindrical furnace. At each subunit elevation, five heat flux samples were taken. FIG. 6 shows the ideal transverse heat flux profile, which was substantially confirmed by prototype test data. FIG. 7 shows the ideal longitudinal heat flux profile that was also substantially confirmed by the prototype test data.

It is clear to those skilled in the art that if the number of heat transfer targets and/or the furnace geometry is different, the same design approach can be used to come up with a design that will achieve the same objective.

As long as the heat flux profiles required by the process are known, this design approach can be used to design a burner assembly to meet those requirements. As a result, this invention can have applications far beyond the embodiment described herein.

Separately, the three principles of burner design discussed herein are known. It is the application of the combination of these principles that is novel. The net outcome is a low-cost burner assembly that satisfies heat flux profile requirements in two orthogonal dimensions simultaneously. Such a burner has wide applicability in different industries, such as hydrogen reformers, ethylene crackers, process heaters, utility boilers, and the like. The key to low cost is the consolidation of flow distribution and burner control.

Although illustrated and described herein with reference to specific embodiments, the present invention nevertheless is not intended to be limited to the details shown. Rather, various modifications may be made in the details within the scope and range of equivalents of the claims without departing from the spirit of the invention.

We claim:

1. A burner assembly having a longitudinal axis and a transverse axis substantially perpendicular to the longitudinal axis, the burner assembly adapted to combust a fuel with an oxidant and thereby generate a longitudinal heat flux profile substantially about the longitudinal axis and a transverse heat flux profile substantially about the transverse axis, comprising:

a plurality of burner units, each burner unit being spaced apart from an adjacent burner unit by a distance, and each burner unit having a heat release rate, a plurality of fuel orifices, each fuel orifice spaced apart from at least one adjacent fuel orifice, and a plurality of oxidant orifices spaced apart from the plurality of fuel orifices, each oxidant orifice spaced apart from at least one adjacent oxidant orifice, wherein each oxidant orifice has a cross sectional area and the plurality of oxidant orifices in each burner unit are arranged in an array of a plurality of different spaced apart groups, each group having at least one oxidant orifice, and at least one group has at least one more oxidant orifice than another group, or the cross sectional area of at least one oxidant orifice in the at least one group differs from the cross sectional area of at least one other oxidant orifice in the another group, whereby the transverse heat flux profile is controlled by the array of the plurality of different spaced apart groups of the plurality of oxidant orifices in the plurality of the burner units, the longitudinal heat flux profile is controlled by at least one of the distance between the adjacent burner units and the heat release rates of the adjacent burner units, and the longitudinal heat flux profile and the transverse heat flux profile are thereby simultaneously controlled by the burner assembly when the fuel is combusted with the oxidant by the burner assembly.

2. A burner assembly as in claim 1, wherein the cross sectional area of the at least one oxidant orifice in the at least one group is less than the cross sectional area of the at least one other oxidant orifice in the another group.

3. A burner assembly as in claim 1, wherein the distance by which each burner unit is spaced apart from the adjacent burner unit is substantially uniform and the heat release rate of at least one burner unit is different than the heat release rate of at least one other burner unit.

4. A burner assembly as in claim 1, wherein the distance by which two adjacent burner units are spaced apart differs from another distance by which another two adjacent burner units are spaced apart.

5. A burner assembly as in claim 1, wherein the distance by which at least one burner unit is spaced apart from the adjacent burner unit is substantially uniform and the heat release rate of the at least one burner unit is different than the heat release rate of at least one other burner unit, and the distance by which two other adjacent burner units are spaced apart differs from another distance by which another two adjacent burner units are spaced apart.

6. A burner assembly as in claim 1, wherein the transverse heat flux profile is substantially uniform.

7. A burner assembly as in claim 1, wherein the longitudinal heat flux profile is variable.

8. A burner assembly as in claim 1, further comprising:

a common fuel supply conduit in fluid communication with each burner unit and adapted to provide a flow of the fuel to each burner unit at a variable fuel input rate or at a constant fuel input rate; and a common oxidant supply conduit in fluid communication with each burner unit and adapted to provide a flow of the oxidant to each burner unit at a constant oxidant input rate or at a variable oxidant input rate, wherein the common fuel supply conduit and the common oxidant supply conduit together are adapted to provide a mixture of the fuel and the oxidant to each burner unit while maintaining a substantially stable longitudinal heat flux profile and a substantially stable transverse heat flux profile.

9. A burner assembly having a longitudinal axis and a transverse axis substantially perpendicular to the longitudinal axis, the burner assembly adapted to combust a mixture of a fuel and an oxidant and thereby generate a longitudinal heat flux profile substantially about the longitudinal axis and a transverse heat flux profile substantially about the transverse axis, comprising:

a plurality of burner units, each burner unit being spaced apart from an adjacent burner unit by a distance, and each burner unit having a heat release rate and a plurality of orifices, each orifice spaced apart from at least one adjacent orifice and adapted to transmit the mixture of the fuel and the oxidant, wherein each orifice has a cross sectional area and the plurality of orifices in each burner unit are arranged in an array of a plurality of different spaced apart groups, each group having at least one orifice, and at least one group has at least one more orifice than another group, or the cross sectional area of at least one orifice in the at least one group differs from the cross sectional area of at least one other orifice in the another group, whereby the transverse heat flux profile is controlled by the array of the plurality of different spaced apart groups of the plurality of orifices in the plurality of the burner units, the longitudinal heat flux profile is controlled by at least one of the distance between the adjacent burner units and the heat release rates of the adjacent burner units, and the longitudinal heat flux profile and the transverse heat flux profile are thereby simultaneously controlled by the burner assembly when the mixture of the fuel and the oxidant is combusted by the burner assembly.

10. A burner assembly having a longitudinal axis and a transverse axis substantially perpendicular to the longitudinal axis, the burner assembly adapted to combust a fuel with an oxidant and thereby generate a longitudinal heat flux profile substantially about the longitudinal axis and a transverse heat flux profile substantially about the transverse axis, comprising:

a plurality of burner units, each burner unit being spaced apart from an adjacent burner unit by a distance, and each burner unit having a heat release rate, a plurality of fuel orifices, each fuel orifice spaced apart from at least one adjacent fuel orifice, and a plurality of oxidant orifices spaced apart from the plurality of fuel orifices, each oxidant orifice spaced apart from at least one adjacent oxidant orifice, wherein each fuel orifice and each oxidant orifice has a cross sectional area and the plurality of fuel orifices and the plurality of oxidant orifices in each burner unit are arranged in an array of a plurality of different spaced apart fuel groups and oxidant groups, each fuel group having at least one fuel orifice and each oxidant group having at least one oxidant orifice, at least one fuel group has at least one more fuel orifice than another fuel group, or the cross sectional area of at least one fuel orifice in the at least one fuel group differs from the cross sectional area of at least one other fuel orifice in the another fuel group, and at least one oxidant group has at least one more oxidant orifice than another oxidant group, or the cross sectional area of at least one oxidant orifice in the at least one oxidant group differs from the cross sectional area of at least one other oxidant orifice in the another oxidant group, whereby the transverse heat flux profile is controlled by the array of the plurality of different spaced apart groups of the plurality of oxidant orifices in the plurality of the burner units, the longitudinal heat flux profile is controlled by at least one of the distance between the adjacent burner units and the heat release rates of the adjacent burner units, and the longitudinal heat flux profile and the transverse heat flux profile are thereby simultaneously controlled by the burner assembly when the fuel is combusted with the oxidant by the burner assembly.

11. A burner unit for use in a burner assembly adapted to combust a fuel with an oxidant and thereby generate at least one heat flux profile, comprising:

a surface having a plurality of fuel orifices, each fuel orifice spaced apart from at least one adjacent fuel orifice, and a plurality of oxidant orifices spaced apart from the plurality of fuel orifices, each oxidant orifice spaced apart from at least one adjacent oxidant orifice, wherein each oxidant orifice has a cross sectional area and the plurality of oxidant orifices are arranged in an array of a plurality of different spaced apart groups, each group having at least one oxidant orifice, and at least one group has at least one more oxidant orifice than another group, or the cross sectional area of at least one oxidant orifice in the at least one group differs from the cross sectional area of at least one other oxidant orifice in the another group, whereby the at least one heat flux profile is controlled by the array of the plurality of different spaced apart groups of the plurality of oxidant orifices when the fuel is combusted with the oxidant.

12. A burner unit as in claim 11, wherein the cross sectional area of the at least one oxidant orifice in the at least one group is less than the cross sectional area of the at least one other oxidant orifice in the another group.

13. A burner unit as in claim 12, wherein at least one oxidant orifice in each group has a circular shape having a diameter (d) or another shape having an equivalent diameter, and wherein $n_1d_1^2=n_2d_2^2=n_3d_3^2=n_4d_4^2=\ldots=n_id_i^2$, where n is a number of oxidant orifices in each group and d is the diameter of the at least one oxidant orifice in each group.

14. A method for operating a burner assembly having a longitudinal axis and a transverse axis substantially perpendicular to the longitudinal axis, comprising the steps of:

providing a plurality of burner units, each burner unit being spaced apart from an adjacent burner unit by a distance, and each burner unit having a heat release rate, a plurality of fuel orifices, each fuel orifice spaced apart from at least one adjacent fuel orifice, and a plurality of oxidant orifices spaced apart from the plurality of fuel orifices, each oxidant orifice spaced apart from at least one adjacent oxidant orifice, wherein each oxidant orifice has a cross sectional area and the plurality of oxidant orifices in each burner unit are arranged in an array of a plurality of different spaced apart groups, each group having at least one oxidant orifice, and at least one group has at least one more oxidant orifice than another group, or the cross sectional area of at least one oxidant orifice in the at least one group differs from the cross sectional area of at least one other oxidant orifice in the another group;

providing a source of a fuel;

providing a source of an oxidant;

transmitting a portion of the fuel through at least one fuel orifice;

transmitting a portion of the oxidant through at least one oxidant orifice; and combusting at least a portion of the fuel transmitted through the at least one fuel orifice with at least a portion of the oxidant transmitted through the at least one oxidant orifice, thereby generating a longitudinal heat flux profile substantially about the longitudinal axis and a transverse heat flux profile substantially about the transverse axis, whereby the transverse heat flux profile is controlled by the array of the plurality of different spaced apart groups of the plurality of oxidant orifices in the plurality of the burner units, the longitudinal heat flux profile is controlled by at least one of the distance between the adjacent burner units and the heat release rates of the adjacent burner units, and the longitudinal heat flux profile and the transverse heat flux profile are thereby simultaneously controlled when the fuel is combusted with the oxidant.

15. A method as in claim 14, wherein the cross sectional area of the at least one oxidant orifice in the at least one group is less than the cross sectional area of the at least one other oxidant orifice in the another group.

16. A method as in claim 14, wherein the distance by which each burner unit is spaced apart from the adjacent burner unit is substantially uniform and the heat release rate of at least one burner unit is different than the heat release rate of at least one other burner unit.

17. A method as in claim 14, wherein the distance by which two adjacent burner units are spaced apart differs from another distance by which another two adjacent burner units are spaced apart.

18. A method as in claim 14, wherein the distance by which at least one burner unit is spaced apart from the adjacent burner unit is substantially uniform and the heat release rate of the at least one burner unit is different than the heat release rate of at least one other burner unit, and the distance by which two other adjacent burner units are spaced apart differs from another distance by which another two adjacent burner units are spaced apart.

19. A method as in claim 14, wherein the transverse heat flux profile is substantially uniform.

20. A method as in claim 14, wherein the longitudinal heat flux profile is variable.

21. A method as in claim 14, comprising the further steps of:

providing a common fuel supply conduit in fluid communication with each burner unit and adapted to provide a flow of the fuel to each burner unit at a variable fuel input rate or at a constant fuel input rate;

providing a common oxidant supply conduit in fluid communication with each burner unit and adapted to provide a flow of the oxidant to each burner unit at a constant oxidant input rate or at a variable oxidant input rate, wherein the common fuel supply system and the common oxidant supply system together are adapted to provide a mixture of the fuel and the oxidant to each burner unit while maintaining a substantially stable longitudinal heat flux profile and a substantially stable transverse heat flux profile;

regulating a flow of the fuel to each burner unit from the common fuel supply conduit; and regulating a flow of oxidant to each burner unit from the common oxidant supply conduit.

22. A method for operating a burner assembly having a longitudinal axis and a transverse axis substantially perpendicular to the longitudinal axis, comprising the steps of:

providing a plurality of burner units, each burner unit being spaced apart from an adjacent burner unit by a distance, and each burner unit having a heat release rate and a plurality of orifices, each orifice spaced apart from at least one adjacent orifice and adapted to transmit a mixture of a fuel and an oxidant, wherein each orifice has a cross sectional area and the plurality of orifices in each burner unit are arranged in an array of a plurality of different spaced apart groups, each group having at least one orifice, and at least one group has at least one more orifice than another group, or the cross sectional area of at least one orifice in the at least one group differs from the cross sectional area of at least one other orifice in the another group;

providing a source of the fuel;

providing a source of the oxidant;

mixing a portion of the fuel and a portion of the oxidant to form the mixture;

transmitting a portion of the mixture of the fuel and the oxidant through at least one orifice;

combusting at least a portion of the mixture transmitted through the at least one orifice, thereby generating a longitudinal heat flux profile substantially about the longitudinal axis and a transverse heat flux profile substantially about the transverse axis, whereby the transverse heat flux profile is controlled by the array of the plurality of different spaced apart groups of the plurality of orifices in the plurality of the burner units, the longitudinal heat flux profile is controlled by at least one of the distance between the adjacent burner units and the heat release rates of the adjacent burner units, and the longitudinal heat flux profile and the transverse heat flux profile are thereby simultaneously controlled by the burner assembly when the mixture of the fuel and the oxidant is combusted by the burner assembly.

23. A method for operating a burner assembly having a longitudinal axis and a transverse axis substantially perpendicular to the longitudinal axis, comprising the steps of:

providing a plurality of burner units, each burner unit being spaced apart from an adjacent burner unit by a distance, and each burner unit having a heat release rate, a plurality of fuel orifices, each fuel orifice spaced apart from at least one adjacent fuel orifice, and a plurality of oxidant orifices spaced apart from the plurality of fuel orifices, each oxidant orifice spaced apart from at least one adjacent oxidant orifice, wherein each fuel orifice and each oxidant orifice has a cross sectional area and the plurality of fuel orifices and the plurality of oxidant orifices in each burner unit are arranged in an array of a plurality of different spaced apart fuel groups and oxidant groups, each fuel group having at least one fuel orifice and each oxidant group having at least one oxidant orifice, at least one fuel group has at least one more fuel orifice than another fuel group, or the cross sectional area of at least one fuel orifice in the at least one fuel group differs from the cross sectional area of at least one other fuel orifice in the another fuel group, and at least one oxidant group has at least one more oxidant orifice than another oxidant group, or the cross sectional area of at least one oxidant orifice in the at least one oxidant group differs from the cross sectional area of at least one other oxidant orifice in the another oxidant group;

providing a source of a fuel;

providing a source of an oxidant;

transmitting a portion of the fuel through at least one fuel orifice;

transmitting a portion of the oxidant through at least one oxidant orifice; and combusting a portion of the fuel transmitted through the at least one fuel orifice with at least a portion of the oxidant transmitted through the at least one oxidant orifice, thereby generating a longitudinal heat flux profile substantially about the longitudinal axis and a transverse heat flux profile substantially about the transverse axis, whereby the transverse heat flux profile is controlled by the array of the plurality of different spaced apart groups of the plurality of oxidant orifices in the plurality of the burner units, the longitudinal heat flux profile is controlled by at least one of the distance between the adjacent burner units and the heat release rates of the adjacent burner units, and the longitudinal heat flux profile and the transverse heat flux profile are thereby simultaneously controlled by the burner assembly when the fuel is combusted with the oxidant by the burner assembly.

* * * * *